US005943299A

United States Patent [19]

Genta

[11] Patent Number: 5,943,299

[45] Date of Patent: Aug. 24, 1999

[54] HOROLOGICAL TIMEPIECE, IN PARTICULAR WRIST WATCH

[75] Inventor: Gérald Genta, Monaco, Monaco

[73] Assignee: Gerald Genta SA, Geneva, Switzerland

[21] Appl. No.: 09/054,884

[22] Filed: Apr. 3, 1998

[30] Foreign Application Priority Data

Apr. 4, 1997 [CH] Switzerland ..... 786/97

[51] Int. Cl.[6] ..... G04B 19/04; G04B 19/24

[52] U.S. Cl. ..... 368/28; 368/80

[58] Field of Search ..... 368/28, 31–40, 368/80

[56] References Cited

U.S. PATENT DOCUMENTS 2,292,458 8/1942 Maser ..... 368/80

3,696,609 10/1972 Dubois .

FOREIGN PATENT DOCUMENTS 666 591 8/1988 Switzerland .

*Primary Examiner*—Vit Miska

*Attorney, Agent, or Firm*—Young & Thompson

[57] ABSTRACT

A timepiece, particularly a wristwatch, comprising a retrograde date display presenting a graduation from 1 to 31 (2) on the dial (1) cooperating with a hand (3) driven by the mechanism which comprises a sleeve (4) comprising this hand and fast with a pinion (5) meshing with two racks (9) pivoted on a plate (6) of the movement acting in opposite direction on the pinion (5), one of said rack being submitted to the action of a return spring, whereas the free end of the other rack is maintained, by the force of said return spring, permanently against a snail cam carried by a date crown (11) pivoted on said plate (6) and driven in a known manner of one step each day by the watch movement.

4 Claims, 1 Drawing Sheet

HOROLOGICAL TIMEPIECE, IN PARTICULAR WRIST WATCH

The present invention relates to a horological timepiece, and particularly to a wristwatch, comprising a date display device of the retrograde type.

The aim of the invention is to provide a control mechanism of this retrograde date display device which is reliable, simple and efficient, which does not take space in the center of the movement and which can be easely adapted to any movement comprising a date crown.

The attached drawing shows schematically and by way of example one embodiement of the object of the invention.

Figure 1:
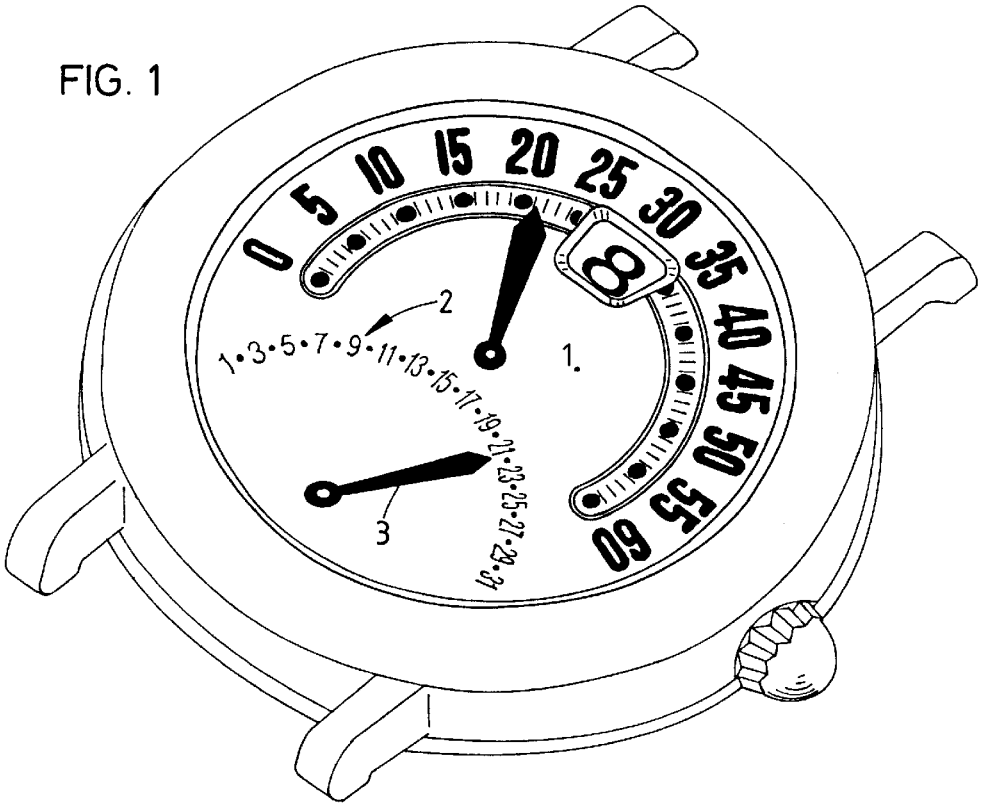
FIG. 1 is a perspective view of a wrist watch.
Figure 2:
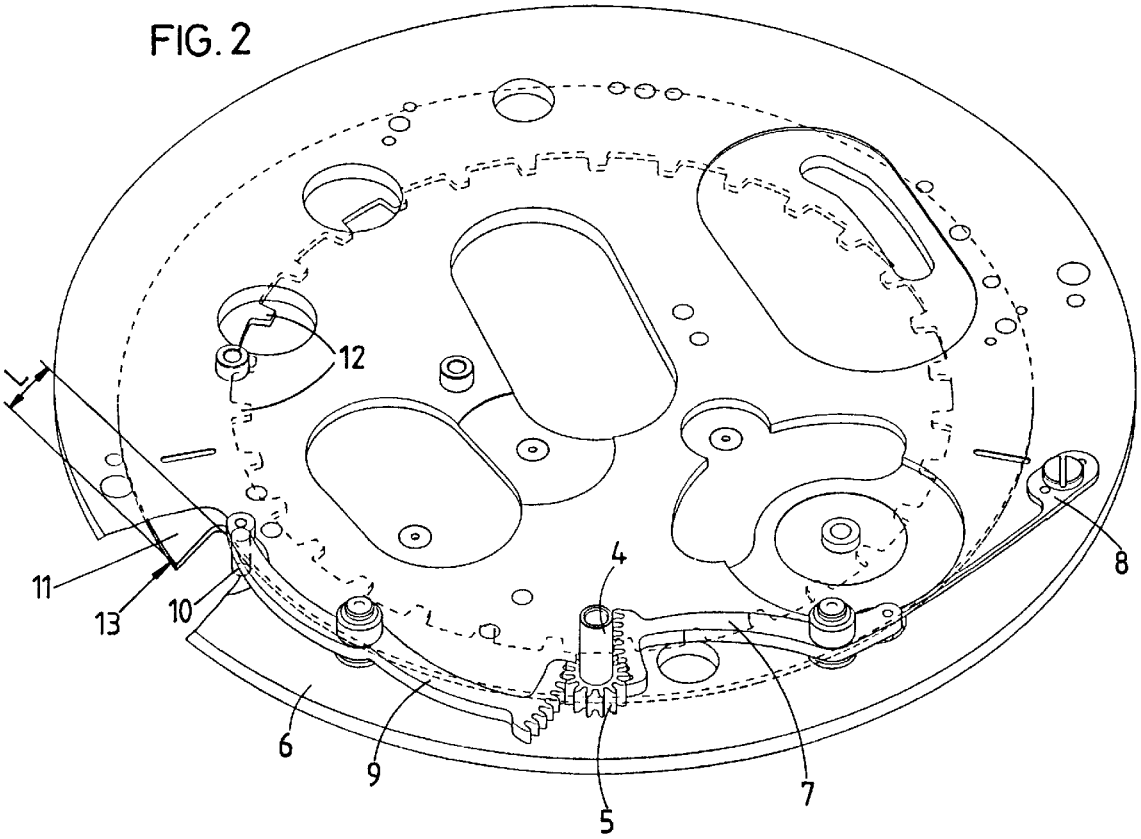
FIG. 2 is a perspective view of the control mechanism of the retrograde data display.

As seen on FIG. 1, the wrist watch comprises a dial 1 provided with a graduation from 1 to 31 for the date 2 cooperating with a hand 3. This hand 3 is driven by a date mechanism so that it is displaced angularly each day of a value corresponding to one step of the graduation 2 and that once arrived at the 31 it is backwardly displaced in one step, i.e. in the reverse direction of the hands of a watch, to display the first day of the following month.

In general, in watches comprising such a retrograde date display, the mechanism driving this display is controlled by a great lever being part of the perpetual calendar mechanism or actuated by a gear train of the movement. These solutions are complicated and necessitate space at the center of the movement, center which is already very encumbered.

The mechanism according to the invention for driving the hand 3 of the date display is very simple and can be adapted to any horological movement comprising a date crown.

The hand 3 of the retrograde date display is carried by a sleeve 4 fastened with a pinion 5 pivoted onto the plate 6.

This pinion 5 is meshing with the toothing of a first rack 7, pivoted on the plate 6 and submitted to the action of a return spring 8 tending to displace the pinion 5 in the anti-clockwise direction.

This same pinion 5 is also in mesh with a second rack 9 also pivoted on the plate 6 on the other side of the axis of the pinion 5. The free end of this second rack 9 comprises a feeler or roller 10 abutting against a date crown 11. This feeler 10 is permanently applied against the outside peripheral edge of the date crown 11, under the action of the spring 8 and the pinion 5. Therefore, the pinion 5, and thus the hand 3, are always positively maintained in a determinated angular position, all the plays of the racks and pinion toothings being eliminated.

The date crown 1 is located in the lower peripheral portion of the plate and pivoted or guided with play by a thicker central portion of said plate 6.

The date crown 11 is maintained in height by bridges (not shown). The driving of the date crown 11 is made by its internal toothing 12 in a conventional and well-known manner by means of a finger or a tooth of a wheel making one revolution each day. The angular position of the crown 11 is maintained, between two successive drivings, by a jumper.

The peripheral edge 13 of the date crown 11 constitutes a helicoidal cam so that for each angular step of the crown 11 the feeler 10 causes an angular step of the sleeve 4 and thus of the hand 3 corresponding to the passage from a day to the following on the graduation 2. After the 31th day of a month, the crown 11 has made a rotation at 360° C. and the feeler 10 falls of the value of the lift L of the cam causing the hand 3 to come back in front of the numeral 1 of the graduation 2.

The modification of the duration of the months is automatically obtained by the setting and winding stem acting on the date crown 11 as in any watches movement comprising a rapid date crown setting.

This mechanism is very simple, it comprises only one pinion 5 and two racks 7,9. It can be located in the periphery of the movement where one has enough space. The data crown 11 is the element controlling the displacement of the hand 3, this crown is well-known but for its peripheral shape which forms the helicoidal cam, or snail cam. All the advantages of this mechanism are due to the fact that the drive actuating the display mechanism of the retrograde date display is made by the date crown and particularly its peripheral edge.

Of course, in variants, the snail cam carried by the date crown could be different, for example formed by a shaped groove machiened in the upper face of the crown.

I claim:

1. Timepiece, particularly wristwatch, comprising a retrograde date display presenting a graduation from 1 to 31 on a dial cooperating with a hand driven by a mechanism, characterized by the fact that said driving mechanism of said hand of the retrograde date display comprises a sleeve comprising said hand fast with a pinion meshing with two racks pivoted on a plate of a movement acting in opposite direction on the pinion, one of said racks being submitted to the action of a return spring whereas the free end of the other rack is maintained, by the force of this return spring, permanently against a snail cam carried by a date crown pivoted onto the said plate and driven one step of each day by the watch movement.

2. Timepiece according to claim 1, characterized by the fact that the snail cam is formed by the peripheral edge of the date crown.

3. Timepiece according to claim 1, characterized by the fact that all the mechanism driving the retrograde date display is located at the periphery of the watch movement.

4. Timepiece according to claim 2, characterized by the fact that all the mechanism driving the retrograde date display is located at the periphery of the watch movement.

* * * * *